US005806449A

United States Patent [19]

Schramayr et al.

[11] Patent Number: 5,806,449

[45] Date of Patent: Sep. 15, 1998

[54] METHOD AND APPARATUS FOR ATTACHING SLEEVES TO SHIRT BODIES

[75] Inventors: Ernst Schramayr, Barneveld; Tadeusz A. Olewicz, New Hartford; Robert J. Sheets, Utica, all of N.Y.

[73] Assignee: Jet Sew Technologies, Inc., Bowling Green, Ky.

[21] Appl. No.: 626,845

[22] Filed: Apr. 3, 1996

[51] Int. Cl.[6] ..... D05B 35/10; D05B 27/10

[52] U.S. Cl. ..... 112/470.29; 112/470.31; 112/475.02; 112/475.09

[58] Field of Search ..... 112/153, 304, 112/305, 306, 309, 322, 475.02, 475.07, 475.12, 470.29, 470.31, 470.32, 475.03; 38/143

[56] References Cited

U.S. PATENT DOCUMENTS

| | | | |
|---|---|---|---|
| 4,046,087 | 9/1977 | Manetti . | |
| 4,053,967 | 10/1977 | Mair | 38/143 X |
| 4,098,021 | 7/1978 | Adamski, Jr. et al. . | |
| 4,185,570 | 1/1980 | Kleinschmidt et al. . | |
| 4,265,187 | 5/1981 | Torre . | |
| 4,467,734 | 8/1984 | Rohr . | |
| 4,512,268 | 4/1985 | Rohr . | |
| 4,665,848 | 5/1987 | Michaels et al. . | |
| 4,827,856 | 5/1989 | Rohr . | |
| 5,131,336 | 7/1992 | Kono et al. | 112/470.33 X |
| 5,251,557 | 10/1993 | Rohr . | |
| 5,269,239 | 12/1993 | Adamski, Jr. et al. . | |
| 5,289,788 | 3/1994 | Fukumoto . | |
| 5,347,238 | 9/1994 | Price et al. | 112/475.09 X |
| 5,349,913 | 9/1994 | Schramayr et al. | 112/475.02 X |
| 5,370,072 | 12/1994 | Adamski, Jr. . | |
| 5,419,268 | 5/1995 | Fyler et al. . | |
| 5,505,149 | 4/1996 | Schramayr et al. . | |
| 5,570,647 | 11/1996 | Adamski, Jr. et al. | 112/470.31 |

FOREIGN PATENT DOCUMENTS

| | | |
|---|---|---|
| 3704856 | 8/1988 | Germany . |
| 301251 | 11/1928 | United Kingdom . |

*Primary Examiner*—Ismael Izaguirre
*Attorney, Agent, or Firm*—Schweitzer Cornman Gross & Bondell LLP

[57] ABSTRACT

A highly efficient, simplified method and apparatus for joining knitted shirt sleeves to shoulder openings of knitted shirt bodies. A knitted sleeve section, oriented outside-out, is engaged by a limited shoulder edge margin only by guide rollers, which can be separated to apply a very limited, controlled circumferential tension to the mounted sleeve section. A knitted shirt body, oriented inside-out, is positioned with a shoulder edge margin directly surrounding the shoulder edge margin of the sleeve section, and also maintained under light tension. A retractable support is positioned underneath the free portion of the sleeve section during loading of the shirt body. The two fabric sections are arranged to be controllably advanced in unison by the guide rollers on which they are supported while a sewing operation is performed. Immediately in advance of the sewing station, the respective shoulder margins are separated by an intervening plate and are individually engaged by active edge guide devices operating in response to a novel arrangement of individual fabric edge positioning sensors for the respective shoulder margins. Immediately in advance of the active edge guides, decurler devices are provided to flatten and extend the edges of the shoulder margins, assuring that the subsequent edge alignment and sewing operations can be accomplished with a high level of accuracy and reliability.

21 Claims, 7 Drawing Sheets

METHOD AND APPARATUS FOR ATTACHING SLEEVES TO SHIRT BODIES

RELATED CASES

This application is related to the copending U.S. Application of Ernst Schramayr et al., Ser. No. 08/423,316, filed Apr. 18, 1995, now U.S. Pat. No. 5,505,149, granted Apr. 9, 1996. The disclosure of said patent is hereby incorporated herein by reference.

BACKGROUND OF THE INVENTION

One of the most difficult procedures in the manufacture of knitted T-shirts has been the attachment of tubular sleeve sections to knitted shirt bodies. In a typical manufacturing procedure for the production of knitted T-shirts, it is customary for shirt bodies and sleeve sections to be separately produced and brought together at a so-called sleeve insertion operation, at which the individual sleeve sections are sewn to the shirt body. The shirt bodies are formed with sleeve openings at opposite sides, and the sleeve sections, previously hemmed at their outer ends, are joined at their raw inner ends to the sleeve openings of the shirt body.

Manual sewing of the sleeve sections to the shirt body is labor-intensive and adds considerable cost to the production of the shirt. Accordingly, significant effort has been made to automate the sleeve insertion procedure, with the objective of enabling it to be performed reliably, with a satisfactory quality level, and at a sufficiently high speed to justify the capital expense of the required equipment.

One of the early efforts to automate the sleeve attachment procedure is reflected in the Ernst Schramayr et al. U.S. Pat. No. 5,349,913, assigned to Jet Sew Technologies, Inc., Barneveld, N.Y. In that patented system, a shirt body is placed over a cylindrical body form, which presents the sleeve openings at opposite ends of the form, with the shirt body oriented "outside-out". Sleeve sections are then applied, with an "inside-out" orientation, hem end first, over the cylindrical body form. Procedures are followed during the application steps to align the raw edges of each shoulder opening and each associated sleeve in a predetermined plane. In a subsequent operation, the two parts are sewn together by operating a sewing head in a circular path about the aligned edges of the sleeve sections and sleeve openings.

Although the system of the '913 patent is an improvement over procedures previously available, a problem has been observed. This problem arose from the necessity of applying the pre-hemmed sleeve section externally over the shirt body supported on a cylindrical form. In some cases, this results in overstretching of the sleeve section, particularly since, in many cases, the hemmed edge of the sleeve section is of smaller diameter than the raw edge to be joined with the sleeve opening.

The problem that is observed in the system of the above mentioned U.S. Pat. No. 5,349,913 is addressed in a subsequent development, which forms the subject matter of copending application Ser. No. 08/294,095, filed Aug. 22, 1994, now U.S. Pat. No. 5,555,833, granted Sep. 17, 1996. In the system of the copending application, provision is made for loading of the sleeve sections onto tapered sleeve cones which are then positioned on the inside of a body form, rather than over the outside as in the system of the '913 patent. A shirt body is then loaded over the body form, and the aligned edges of the sleeve sections and shirt bodies are sewed by a circular movement of the body form relative to a sewing head.

While in the apparatus of the '913 patent, the sewing head itself is caused to traverse through a circular path for sewing the shoulder seam, in the apparatus of the pending application, the loaded body form preferably is detached from its loading position and the body form itself is caused to rotate relative to a fixed sewing head.

The system of the pending application Ser. No. 294,095 represents an improvement over the patented apparatus in that the sleeve sections are exposed to less stretching. They are nevertheless still exposed to some degree of stretching in order to load them onto the conical sleeve cones. In addition, and possibly more importantly, the various body and sleeve forms utilized in the operation are size specific. Accordingly, a plurality of sets of forms are required for the manufacture of a full range of shirt sizes, which adds to the capital requirements of the system.

In the method and apparatus of the Schramayr et al. U.S. Pat. No. 5,505,149, the problems observed in the earlier systems described above are addressed, enabling the sleeve insertion operation to be accomplished with a considerably reduced cycle time, and with much simpler, less costly equipment. In accordance with procedure of that application, each sewing location is provided with a load fixture which receives and supports only a narrow marginal portion of the raw (shoulder) edge of a sleeve section, allowing the hemmed end of the sleeve section to hang free. The shoulder section of a shirt body is then loaded over the sleeve section, and a narrow margin of fabric adjacent the sleeve opening is supported in surrounding relation to the previously loaded sleeve section. Only the shoulder edge margin of the shirt body is engaged and supported. For each of the edge margins, there is provided an edge sensing element, and an active edge guide device which responds to signals from the edge sensing element and serves to independently align the respective fabric edges on a continuous basis.

After loading of the sleeve and body sections, a sewing head is activated, and the edge margins of the sleeve and body sections are advanced past the needle position of a stationary sewing head to enable the sewing operation to take place. As the sewing progresses, the edges of the sleeve section and shirt body are automatically and independently aligned, immediately in advance of sewing. Among other things, this allows the machine operator to load the sleeve section and shirt body onto the load fixture with relatively minimum regard for precise initial alignment.

In the method and apparatus of the present invention, the system of U.S. Pat. No. 5,505,149 is enhanced significantly by the provision of several improvement features serving to expedite the procedure while at the same time improving the quality of the resulting product. One of these is the use of special decurler blades, located directly in advance of the active edge guides which uncurl and flatten the edge extremities of the sleeve section and shoulder opening. As a result of this operation, when the fabric moves into engagement with the inner and outer active edge guide devices, the marginal extremities of both fabric sections are flat and can be accurately and reliably manipulated by the active edge guides. Immediately following the active edge guides, and immediately in advance of the sewing station, the respective edges of the sleeve section and shoulder opening are detected by edge sensors, which control the active edge guides to move the respective fabric edges one way or the other, toward a predetermined reference position. The flat and decurled condition of the fabric sections at this stage assures the highest degree of accuracy in edge alignment of the fabric sections, as will be understood.

In a preferred form of the invention, a particularly advantageous form of decurling device comprises an arrangement of three blades, defining two flat, thin spaces for the passage of the respective fabric edge portions. Each blade has on the surfaces thereof which face the fabric a series of openings for the discharge of air jets in a direction toward the edge of the fabric, so as to tend to flatten a fabric edge as it passes between two of the blades. In this respect, the center one of the three blades, has opposed surfaces each of which faces toward a fabric section, and thus has air discharge openings on both its upper and lower faces. In addition, the upstream edge of the center blade is recessed with respect to the upstream edges of the upper and lower blades so that both sections of fabric, as they advance to the decurler, initially proceed into an entry chamber formed between the upper and lower blades of the decurler. The fabric sections then separate and advance into two individual upper and lower decurling spaces formed by the presence of the center blade.

The center blade of the decurler advantageously is provided along its leading or upstream edge with a plurality of air openings, directed at an angle toward the edge extremities of the fabric. Accordingly, where the fabric sections are curled toward the center blade, as is the normal condition, the curl is substantially flattened out while the fabric remains in the somewhat larger entry space defined by the upper and lower blades. This significantly facilitates the completion of the decurling that occurs as the fabric sections enter into their respective individual decurling spaces between the center blade and the respective outer blades. The center blade of the decurler is retractable, and a sensor element is provided immediately in advance thereof to detect the approach of the leading edge of the sewn seam, as the sewing operation nears completion. The decurler blade is immediately retracted to enable continued advancement of the sewn seam while the sewing operation is completed.

In the preferred method and apparatus of the invention, each sewing station is provided with a retractable support arranged to be projected underneath a sleeve section during a loading operation. The support elevates the limp outer end portions of the sleeve and thus facilitates the subsequent operation of applying the shoulder opening of a shirt body onto the apparatus, in surrounding relation to the sleeve section. The support is withdrawn to a retracted position during the sewing operation.

Yet another advantageous feature provided in a preferred embodiment of the invention is an improved form of edge sensing system which accommodates the presence of a reinforcing tape, disposed transversely to the stitch line and projecting beyond the normal edges of the fabric elements being aligned. In some garments of higher quality, a sewn seam in the body section, which extends from the neck opening laterally to the shoulder opening, is installed in an operation prior to the sleeve insertion. Typically, an extending end of the reinforcing tape projects beyond the edge of the shoulder opening, and the operation of cutting the excess tape is postponed, for the sake of efficiency of operations, until after the sleeve has been installed and sewn in place in the shoulder opening. In a preferred system according to the invention, provision is made in the edge sensing facility for, in effect, recognizing the passage of the reinforcing tape and avoiding unnecessary activation of the edge alignment device, so that the system does not attempt to relocate the fabric edge in an effort to align the projecting edge of the tape.

For a more complete understanding of the above and other features and advantages of the invention, reference should be made to the following detailed description of preferred embodiments of the invention and to the accompanying drawings.

DESCRIPTION OF A PREFERRED EMBODIMENT OF THE INVENTION

Figure 1:
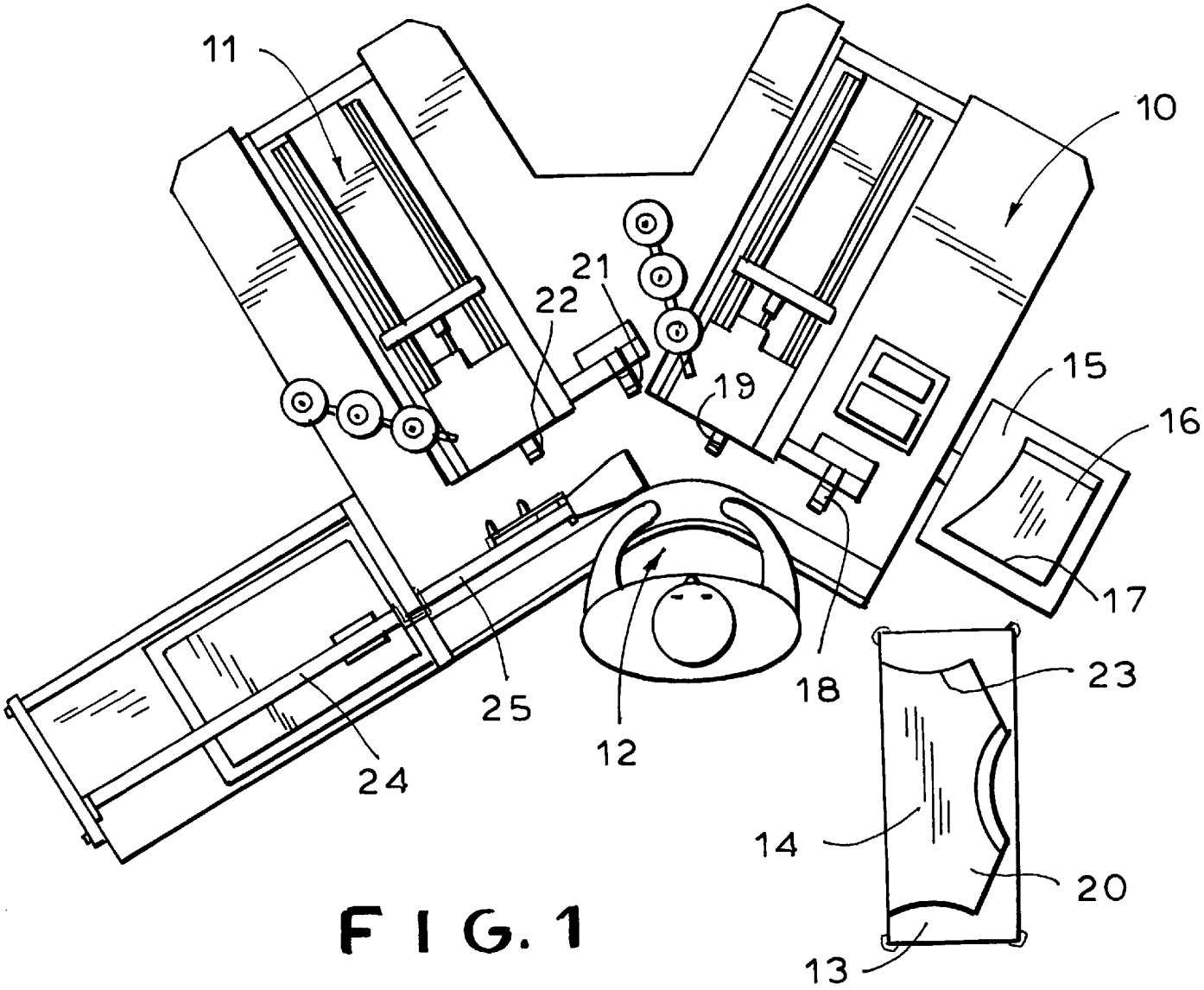
FIG. 1 is a simplified, schematic top plan layout of an ergonomically arranged installation for sewing of sleeve elements onto shirt bodies in accordance with the teachings of the invention.

Referring now to the drawings, and initially to FIG. 1 thereof, an advantageous, ergonomically designed installation incorporating the method and apparatus of the invention comprises a pair of sewing stations 10, 11 arranged in angular relation, for example at an angle of about 60° to each other, and facing an operator position 12. To the operator's right, in the illustration of FIG. 1, is a first supply table 13 holding a supply of shirt bodies 14, and a second supply table 15 holding a supply of sleeve elements 16.

As will be described in greater detail hereinafter, an operator will first load the sewing station 10 with a sleeve section 16. The sleeve section advantageously is loaded with a right-side-out orientation, with its shoulder margin 17 engaged by spaced-apart guide rollers 18, 19. A shirt body 14 is then loaded onto the sewing station 10, with the shirt body arranged with an inside-out orientation, and a first shoulder margin 20 of the shirt body being placed over the guide rollers 18, 19, in closely surrounding and overlying relation to the shoulder margin of the previously loaded sleeve section. At this stage, and by means to be more fully described, the sewing station 10 is actuated and the overlaid components are advanced past the sewing head to secure the shoulder margin 17 of the sleeve section 16 to the shoulder margin 20 of the shirt body 14.

While the sewing operation is proceeding in the sewing station 10, the operator proceeds to load a second sleeve section 16 onto the second sewing station 11, by placing the shoulder margin 17 thereof over guide rollers 21, 22. Typically, as the operator completes the loading of the second sleeve section onto the second sewing station 11, the sewing operation at the first station 10 has been completed, and the operator may immediately load the second shoulder margin 23 of the shirt body onto the guide rollers 21, 22, in surrounding and overlying relation to the previously loaded second sleeve section. Sewing may then proceed at the second sewing station to complete the attachment of sleeve sections 16 to both sides of the shirt body 14. The completed shirt is then engaged by a stacker mechanism 24 which, per se, forms no part of the present invention. An arm 25 of the stacker mechanism engages the completed shirt and withdraws it from the sewing area, placing it in a suitable stacker tray or the like.

Figure 2:
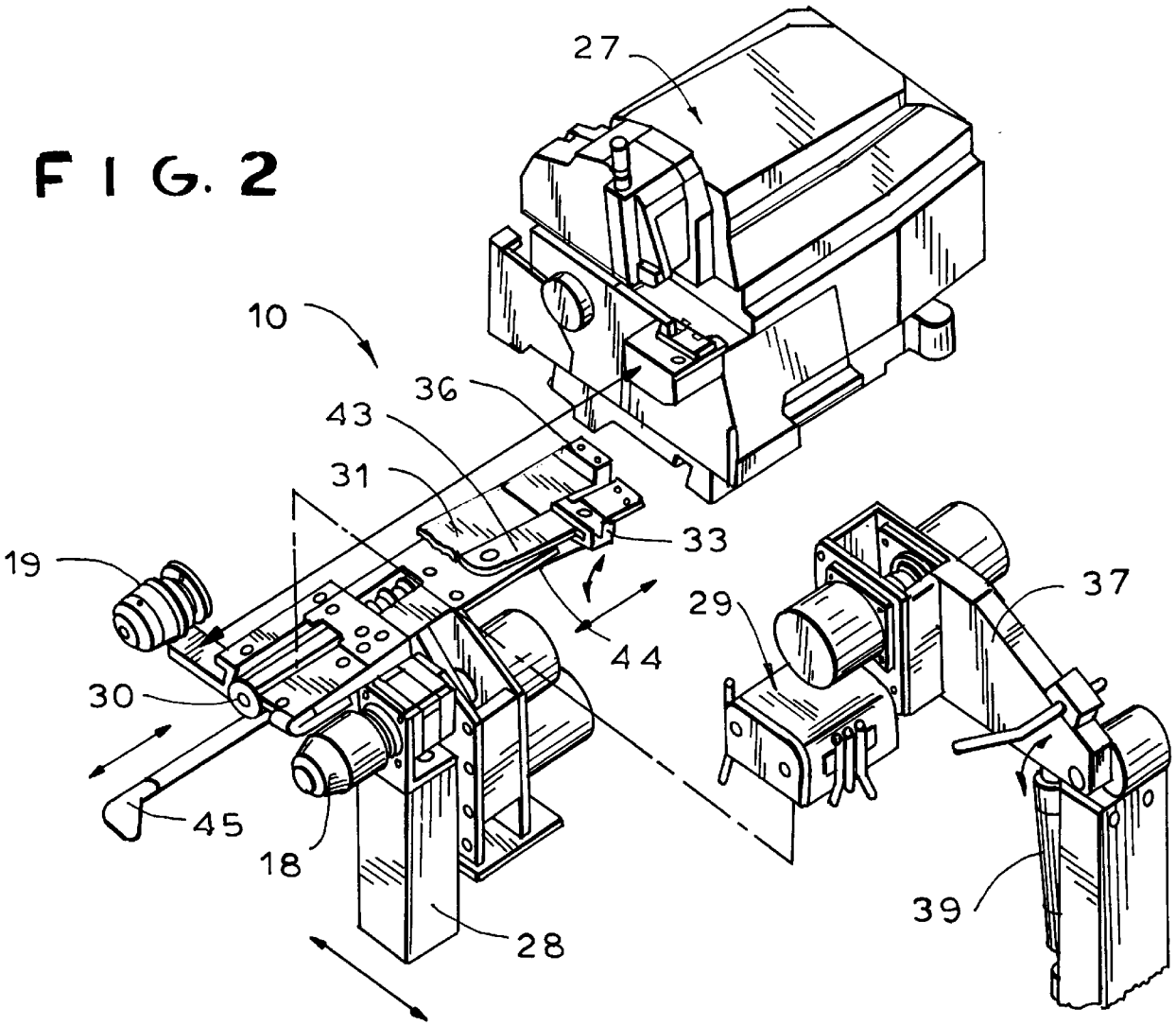
FIG. 2 is an exploded perspective view of one of two sewing stations incorporated in the installation of FIG. 1, illustrating details of construction and operation.
Figure 3:
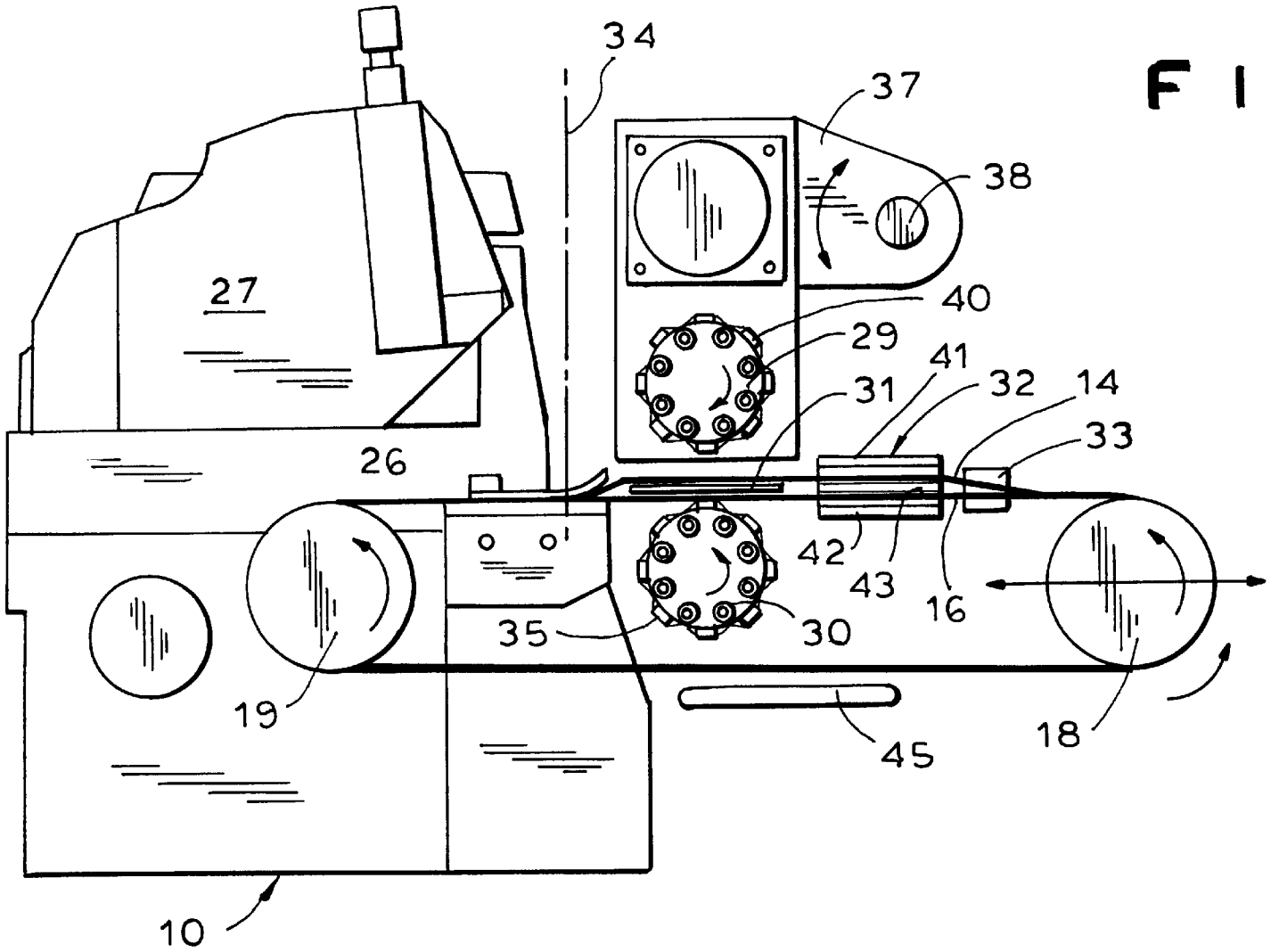
FIG. 3 is a front elevational view of the sewing station of FIG. 2.

FIGS. 2 and 3 illustrate further details of the sewing station 10. The station 11 is essentially identical to the sewing station 10, so only the station 10 will be described in further detail. As shown in FIG. 2, the sewing station includes guide rollers 18, 19, which are mounted in horizontally separated relation and define a circumferential path approximately equal to the circumference of the shoulder margins 17, 20, 23. In the illustrated form of the invention, the guide roller 19 is freely rotating, while the guide roller 18 is controllably driven for operation in synchronism with a sewing head 27. One of the guide rollers 18, 19, and preferably the driven roller 18, is mounted on a pedestal 28 for controlled movement toward and away from the opposing guide roller 19 under the influence of a sensitive actuating means, such as a low pressure fluid actuator, for example. The arrangement is such that the guide rollers may easily be moved in a closing direction as necessary for loading of the sleeve and body sections. After initial loading of the fabric elements 14, 16, the guide roller 18 moves to the right, advantageously under controllable pressure, such as by a low pressure pneumatic actuator (not shown) to apply a controllably limited amount of circumferential tension during the sewing operation.

As viewed in FIG. 3, the guide rollers 18, 19 are operated in a counterclockwise direction, so that fabric sections 14, 16 supported thereon are caused to move from right to left along the upper reach of the path defined by the guide rollers.

Located between the guide rollers 18, 19, in a direction from the roller 19 to the roller 18, are the sewing foot 26, upper and lower active edge guide devices 29, 30 arranged on opposite sides of a separator plate 31 for independent engagement with the shirt body and sleeve margins 22, 17 respectively. Immediately upstream of the edge guide devices 29, 30 is an advantageous form of decurling device 32, to be described in more detail, for assuring that the fabric edges are free of curl for the edge alignment operations. Immediately upstream of the decurling device 32 is a seam sensing device 33 arranged to detect the advancement of the sewn seam, as the sewing operation nears completion, to initiate retraction of the decurling device 32 and the separator plate 31 from between the fabric layers and allow the advancement of the seam toward the sewing axis 34 to enable completion of the seam.

In the illustrated form of the invention, the lower edge alignment device 30 is mounted on a fixed, horizontal axis for engagement with a lower surface of the sleeve section 16. The edge alignment device is rotated synchronously with the fabric movement, and belt-like surface elements 35 of the device 30 engage the fabric section 16 against the lower surface of the separator plate 31 and, under the control of an edge sensing system to be described, cause the edge margin of the sleeve section 16 to be laterally displaced as necessary for proper alignment with the sewing needle, as reflected by the sewing axis 34. As shown in FIG. 2, the separator plate 31 is carried by a separator mount 36, which is adapted for horizontal movement enabling the separator plate to be positioned between edge margins of the fabric sections 14, 16, as shown in FIG. 3, or retracted therefrom as shown in FIG. 2, to accommodate passage of the sewn seam. In addition, the separator plate mount is adapted for limited pivoting movement, enabling the separator plate 31 to be elevated relative to the lower edge alignment device 30 to facilitate the loading of an edge margin of a sleeve section 16 into the space between the separator plate and the alignment device.

The upper edge alignment device 29 is preferably mounted on a pivot arm 37, movable about a pivot axis 38 by means of a fluid actuator 39 or the like. For normal operation, the upper edge alignment device 29 is rotated in a clockwise direction, and belt-like surface elements 40 thereof engage edge margins of the shirt body shoulder opening, pressing the same against an upper surface of the separator plate 31, to enable the edge margin to be manipulated laterally, as necessary for alignment with the sewing axis 34. For loading and unloading operations, the support arm 37 is pivoted upwardly, to position the upper edge alignment device 29 above the separator plate, which itself is somewhat elevated at this time to provide clearance from the lower alignment device 30.

The decurler device 32, which will be described in greater detail, consists in general of upper and lower guide blades 41, 42 and a center blade 43. Desirably, the center guide blade 43 is movable with the mount 36 for the separator plate, enabling the center blade to be retracted with the separator plate for passage of the sewn seam, and elevated for loading. In addition, the upper blade 41 is movable with the upper edge alignment device 29, enabling elevation of the blade 41 to facilitate loading operations.

As illustrated in FIG. 2, the sewn seam sensor 33 and its associated sensing probe 44 advantageously are mounted together with the separator plate 31 and movable decurler element 43.

To particular advantage, a retractable sleeve support 45 (FIGS. 2 and 3) is extendable to be positioned directly below the lower fabric guide path, preferably directly below the straight line path between the lower portions of the guide rollers 18, 19, and approximately midway between those guide rollers. During the loading of a sleeve section 16 onto the guide rollers, the sleeve support 45 is extended to the position shown in FIG. 2, wherein the center portion of the sleeve section is supported from underneath and prevented from draping downward to such an extent as to interfere with the subsequent loading of a shirt body section 14. The length of the sleeve support 45 is not particularly critical, and it is not necessary that it provide support for the entire length of the sleeve section, as long as a substantial length of the sleeve section is supported and any unsupported end portion does not drape downward far enough to hinder the subsequent loading operation. When the body section 14 is loaded in surrounding relation to a previously loaded sleeve section 16, the extended sleeve support 45 will project into the sleeve opening. Thus, the profile of the sleeve support is such as to easily accommodate its reception within the body sleeve opening during the loading process. Once the loading operation has been completed, the sleeve support 45 is retracted to enable the subsequent sewing operations to take place.

Figure 4:
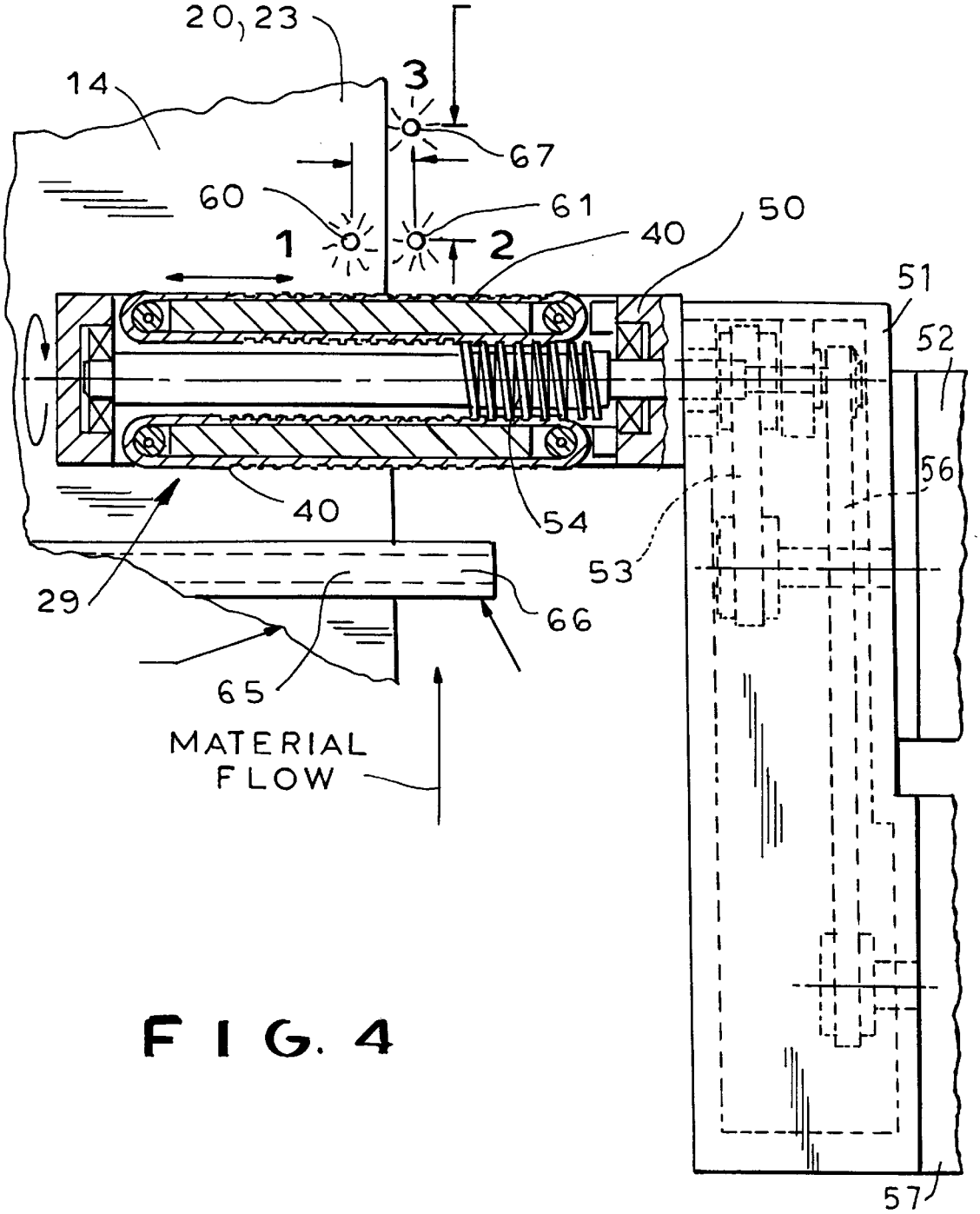
FIG. 4 is an enlarged, fragmentary top view, partially in section, showing details of edge sensing and active edge guide means incorporated in the apparatus of the invention.
Figure 5:
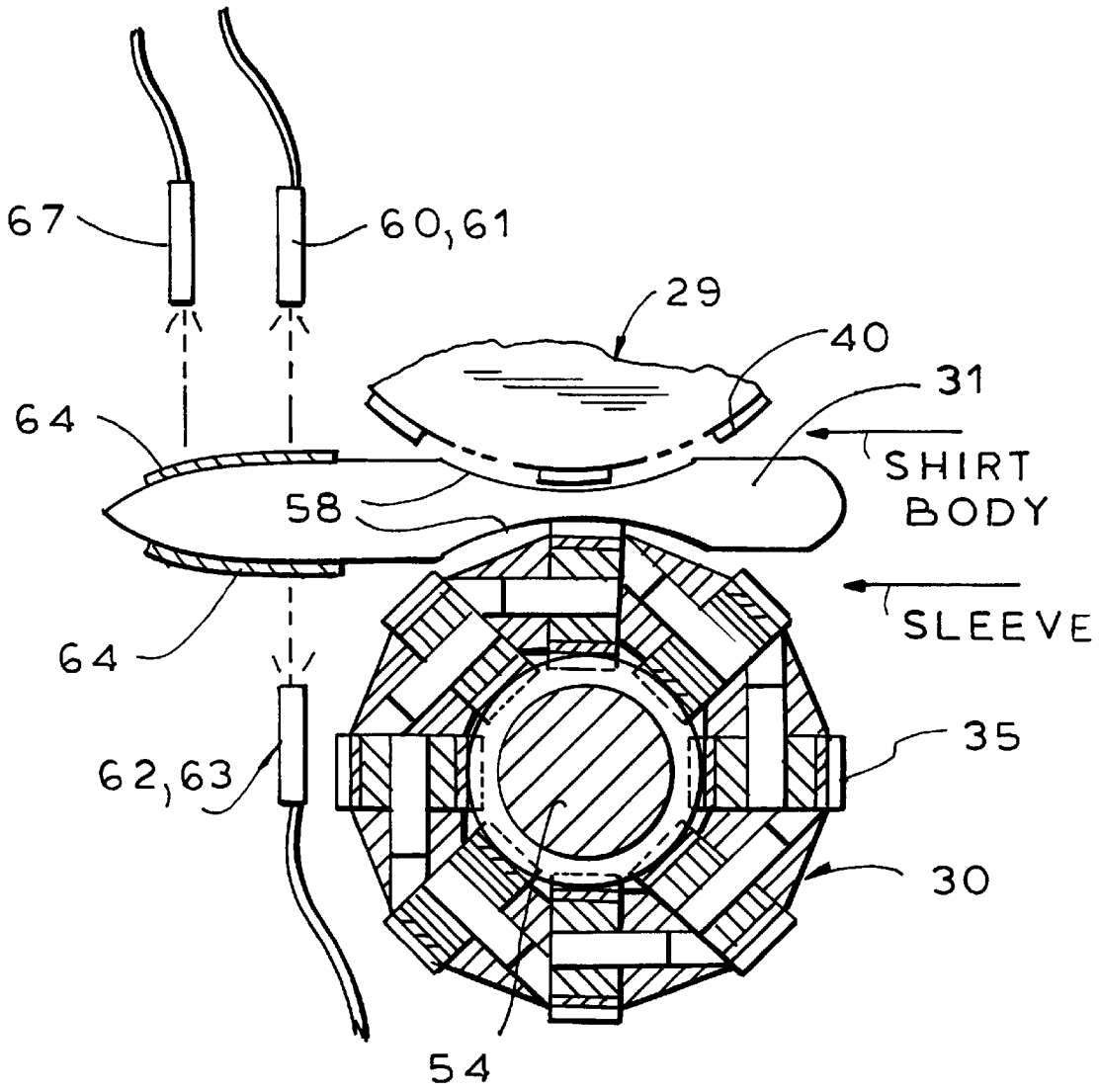
FIG. 5 is an enlarged, fragmentary, cross sectional view, showing features of the edge sensing and active edge guide means of FIG. 4.

Referring now to FIGS. 4 and 5, there is shown details of an advantageous form of active edge device employed in a preferred system of the invention, as well as features of a novel and advantageous form of edge sensing system which is utilized in conjunction therewith. The active edge guide device preferably is a commercially available device such as manufactured by Sahl Machinery Co. (Austria).

With reference to FIG. 4, the upper active edge guide device 29 comprises a generally cylindrical body 50 which is mounted for rotation on a support 51 and is driven for controlled rotation by means of a motor 52 and drive belt 53. In general, the operation of the motor 52 is synchronized with that of the driven guide roller 18, so that the rotation of the body 50 corresponds to the rate of movement of the fabric section 14, as driven by the guide roller 18 and the sewing head 27. The body 50 of the edge guide device supports a plurality of flexible belt-like surface elements 40 formed with a grooved outer surface adapted for driving engagement with an internal, threaded worm shaft 54. The shaft 54 is mounted for rotation within the body 50 and has a portion 55 extending into the support 51 and engaged by a drive belt 56. The drive belt 56 is engaged by a controllably driven motor 57. The arrangement is such that, when the body 50 and shaft 55 rotate in unison, the surface elements 40 (or 35 in the case of the lower unit 30) remain stationary. However, in response to indicated misalignment of a fabric section, the motor 57 is controllably adjusted to speed up or slow down the rotation of the shaft 55 relative to the rotating main body 50, causing a relative rotation between these elements and thereby causing the surface elements 40, 35 to be driven in an appropriate direction to adjust the position of the fabric section laterally.

As shown in FIG. 5, when the system is in operation, the upper and lower edge guide units 29, 30 are positioned to have light contact with the separator plate 31, which advantageously can be provided with concave grooves 58 corresponding to the path of travel of the fabric-engaging surface elements 40, 35. In the illustrated arrangement, each of the edge control devices is provided with eight radially spaced fabric-engaging elements 40, 35 spaced radially at 45°, and the concave grooves 58 are contoured to assure that the fabric is at all times engaged by at least one of the elements 40, 35 so as to be continually under the control of the edge alignment device as the fabric is advanced during a sewing operation.

As shown in FIG. 4, a fabric section, and in the case of the illustration a shirt body 14, is advanced with its shoulder margin 20, 23 passing under the edge alignment device 29, and the shoulder margin 17 of the sleeve section passing over the lower edge alignment device 30, with the two sections being separated in this region by the plate 31 to accommodate independent edge alignment of the separate sections in accordance with previously known principles.

Also in accordance with known principles, means are provided for detecting the location of the edge extremity 59 of a fabric section, in an area between the edge guide devices and the sewing axis 34. Pursuant to known techniques, combination light source and photocell devices 60, 61 are provided which are spaced apart in straddling relation to the fabric edge 59. The spacing between the sensors 60, 61 is determined by the permissible tolerance for "wandering" of the fabric edge during sewing. A similar set of photocell-sensor devices 62, 63 is provided underneath the separator plate 31 for detecting the edge of the sleeve section 16. To advantage, elements of reflecting tape 64 may be provided on the surface of the separator plate, so that light is efficiently reflected to the sensors 60–63 when areas of the tape directly opposed thereto are exposed.

As long as the fabric edges remain between straddled by the respective sensors pairs 60, 61 and 62, 63, the belt-like fabric-engaging elements 40, 35 remain stationary with respect to their supporting bodies 50. If the fabric wanders in an outward direction, exposing reflective tape underneath the sensors 60 or 62, the fabric-engaging belts 40 or 35 are activated to displace the fabric in an inward direction (toward the right in FIG. 4) until the sensor 60 and/or 62 no longer "see" the reflecting tape 64. Conversely, if the fabric edge wanders inwardly, to cause the reflective tape 64 to be opposite the sensors 61 or 63 to be covered, the fabric-engaging surface elements 40, 35 are actuated in an opposite direction, to move the fabric edge outwardly until the reflecting tape is no longer covered. The upper and lower edge aligning devices 29, 30 operate independently, as will be understood, so that alignment of the shirt body edge is independent of alignment of the sleeve section edge.

In some of the higher quality shirt constructions, a sewn seam extending from the neck opening to the shoulder openings of the shirt body may be reinforced by the use of a section of reinforcing tape 65 (FIG. 4) which is installed in an earlier operation. Typically, where such a reinforcing tape is applied, it is longer than necessary and may leave a short tail 66 which projects beyond the edge 59 of the shirt body shoulder margin. Typically, this extra tail is not removed until after the sleeve section is sewn to the shoulder opening of the shirt body, at which time the tail of the reinforcing tape can be severed and removed along with the excess margin of material at the sewn seam.

In accordance with one aspect of the invention, a special form of sensing device is provided for sensing the edge of the shirt body, which is able to differentiate between a normal displacement of the fabric edge and the passage of the reinforcing tape, such that the upper edge alignment device 29 is not activated in an attempt to align the projecting outer extremity of the reinforcing tape with the sewing axis. To this end, a third sensor 67 is provided, which is aligned with the inner sensor 61, in the direction of movement of the fabric, but is spaced therefrom in such direction by a distance at least slightly greater than the width of the reinforcing tape. In order to activate the control motor 57, to drive the fabric-engaging elements 40 in a direction to displace the fabric edge 59 outwardly (as in response to an inward wandering of that edge), it is necessary that both of the sensors 61, 67 be activated by covering of the reflective tape opposite thereto. Thus, as can be understood with reference to FIG. 4, if the entire edge 59 wanders to the right (inwardly) light reflection to both of the sensors 61 and 67 will be interrupted. However, when the edge 59 is otherwise in a proper position, straddled by the sensors 60, 61, and a projecting tail 66 of reinforcing tape 65 passes underneath, reflection to the sensor 61 would be blocked. However, the sensor 67, spaced downstream therefrom remains exposed to light reflection. Since reflection to both sensors 61 and 67 is not blocked, no signal is given to the motor 57 to initiate a correcting motion. As the reinforcing tape advances toward and eventually underneath the second sensor 67, to block light reflection thereto, it first clears the upstream sensor 61, because the distance between the two sensors 61, 67 is at least slightly greater than the width of the tape. Accordingly, by the time the sensor 67 is blocked, the sensor 61 is cleared, and again no correction signal is directed to the motor 57.

Typically, the sleeve section 16 will not have a sewn seam running longitudinally of the sleeve, so that the extra sensor is not necessary for controlling the edge of the sleeve.

In the method and apparatus of the invention, provision is made for effecting a decurling and prealignment of the fabric margins 17, 20, 23, immediately in advance of the active edge guide elements. This arrangement assures that the fabric margins, when they reach the active edge guide devices, and more particularly when they reach the optical sensors 60–63 and 67 will be in a flat, fully extended condition, to enable optimum accuracy to be achieved in the edge alignment immediately preceding the sewing operation. In this respect, knitted fabrics in particular tend to curl at a cut edge, and especially so when any tension is applied thereto. To the extent that an edge is in a curled condition as it approaches one of the edge alignment devices 29, 30, and thereafter the edge sensing devices, the aligned edge may not be the actual edge of the fabric, but a fold line of the fabric, resulting from a curled edge having passed through the active edge guides 29 or 30. To deal with this problem, the method and apparatus of the invention incorporate at least one decurler device 32, positioned immediately upstream of the edge guide devices 29, 30, for removing edge curl from the fabric and assuring that the edges are in flat and extended condition when they are engaged by the edge guide devices and when they are detected by the sensing devices. Significantly improved accuracy in the sewing operation is thereby achieved, resulting in a higher quality output.

Figure 6:
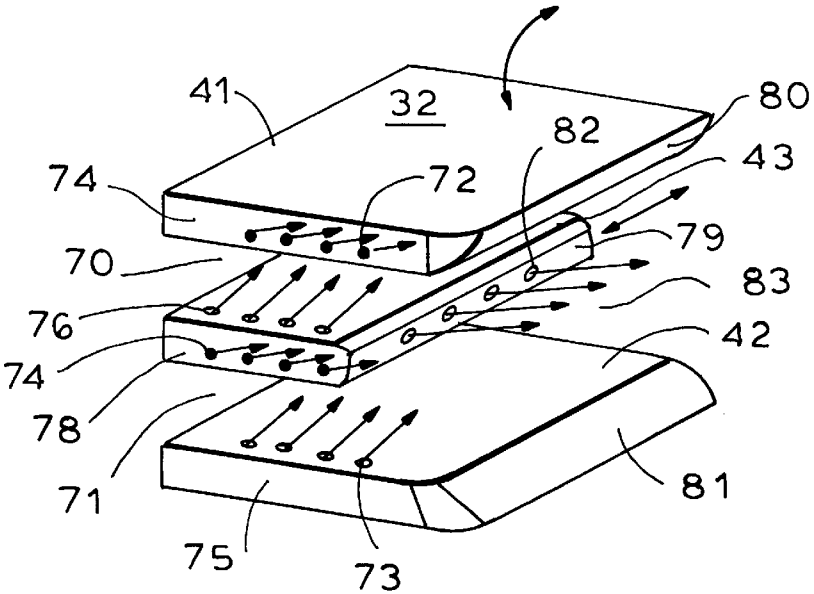
FIG. 6 is an enlarged perspective view, illustrating an advantageous form of decurler device incorporated in the system of the invention.

Although decurler devices are in general known and their use in other operations is known, the device disclosed herein has certain advantages which increase its suitability generally and in particular for the purposes of the procedure illustrated. As shown in FIG. 6, the decurler device 32 comprises upper and lower guide blades 41, 42 and an intermediate guide blade 43, together forming upper and lower guide slots 70, 71, respectively. The edge margins 20, 23 of the shirt body pass through the upper guide slot 70, while the margin 17 of the sleeve section passes through the lower guide slot 71. The thickness of the respective slots is slightly greater than the thickness of the respective fabric sections, to allow easy passage of the fabric including, with respect to the body section, a previously formed seam which extends along the shoulder, from the neck to the shoulder opening and may include a reinforcing tape 65. Typically, one or both of the outer blades 41, 42 are spring mounted, so as to be outwardly displaceable if necessary to accommodate the passage of an object of greater than normal thickness.

As illustrated in FIG. 6, the upper and lower confining blades 41, 42 are provided with a series of air outlet openings 72, 73, which are located near the outer end edges 74, 75 of the respective blades and are directed at a low angle in a direction toward the opposite or inner ends of the blades. These outlet openings are in communication with internal passages (not shown), within the blades, which are connected to a suitable source of air under pressure (also not shown). The center blade 43 similarly is provided with backwardly angled air openings 76, 77 on its upper and lower surfaces, adjacent its outer edge 78.

In a particularly preferred embodiment of the invention, the intermediate or center blade 43 is arranged so that the leading or upstream edge 79 thereof is displaced in a downstream direction from the leading or upstream edges 80, 81 of the respective upper and lower blades 41, 42. Typically, the center blade 43 will be of narrower width than the upper and lower blades, and in any case the leading edge 79 of the center blade is displaced in a downstream direction from the leading edges 80, 81 of the outer blades.

In addition to its downstream displacement, the leading edge 79 of the center blade is provided with a series of air discharge openings 82 spaced along the edge and directed at an angle, to have both forward and inward components. The discharge and flow of air from the various openings is reflected by the various arrows shown in FIGS. 6–10.

Figure 10:
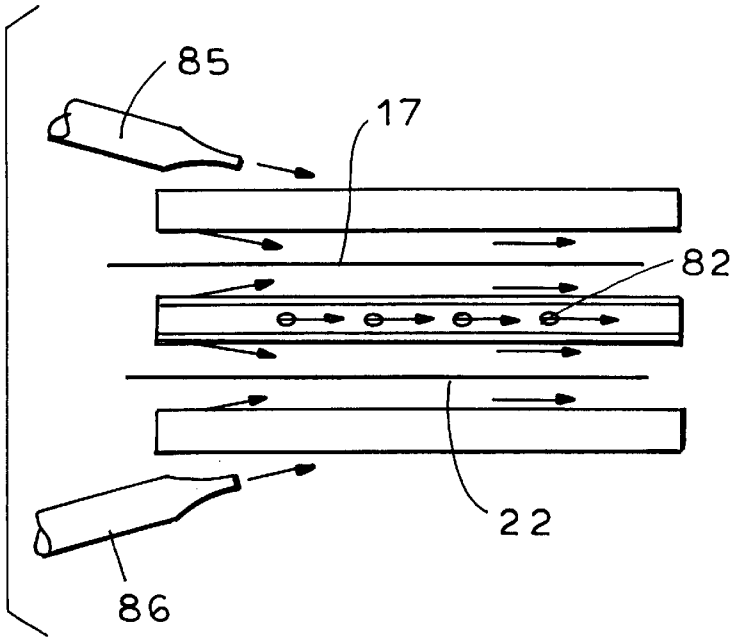
FIGS. 9 and 10 are side elevational views, similar to FIG. 8, showing the condition of fabric advancing toward the decurler device, and after entering the decurler device respectively.
Figure 9:
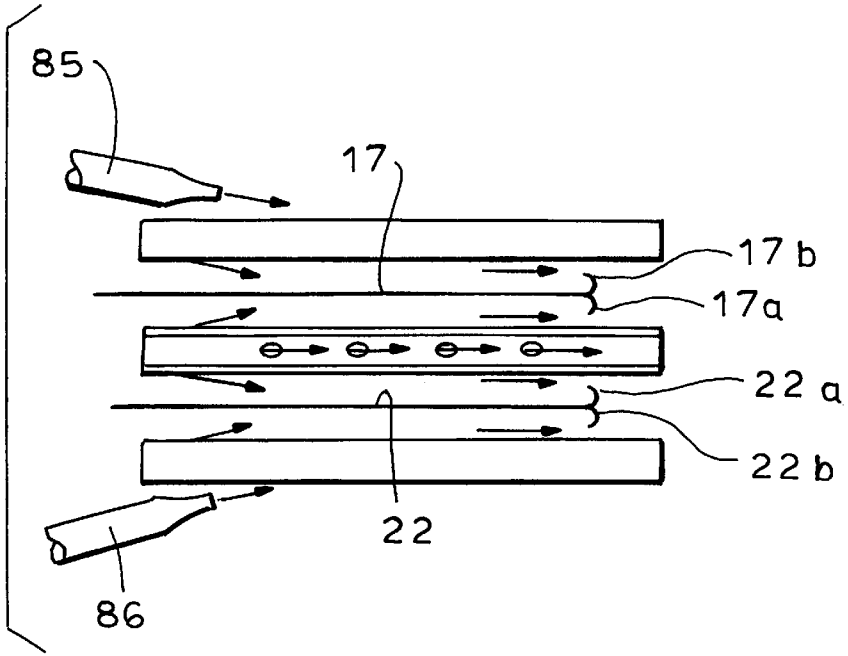

FIGS. 9 and 10 illustrate in principle the processing of fabric edges in the decurler device 32. As the respective shoulder margins 22, 23 or 17 approach the forward or upstream side of the decurler device, the edge extremities of the fabric may contain either an inward curl, as indicated at 17*a*, 22*a* or, in some cases, an outward curl, as indicated at 17*b*, 22*b*. In the arrangement of the invention, where the sleeve sections 16 are processed with an "outside-out" orientation, while the shirt body sections 14 are processed with an "inside-out" orientation, it is typical and expected that the tendency to curl at the edges will be to the inside, as reflected at 17*a*, 22*a*. Occasionally, the curl may be in the other direction, toward the outside, but this is less frequent and typically less severe.

For an inwardly curled fabric condition, as the fabric margins 17*a*, 22*a* approach the decurler device, fabric portions first enter an enlarged chamber 83 defined by those portions of the upper and lower guide blades 41, 42 which project in a forward or upstream direction from the edge 79 of the center blade. As the fabric elements enter this chamber, they are acted upon by the jets of air issuing from the openings 82, having the effect of partially or completely flattening the curl portions 17*a*, 22*a* before the fabric enters the confined guide slots 70, 71. While being acted upon by the forwardly/inwardly directed air flow from the openings 82, the fabric sections will tend to separate, and will be supported by the projecting portions of the upper and lower blades 41, 42. This both facilitates the decurling action and prevents "flagging" of the edges of the fabric. Once the fabric margins are within the confined passages 70, 71 any remaining curl condition is eliminated, and the fabric is maintained in a flat, extended condition.

Inasmuch as the decurler device is closely coupled with the active edge guide devices 29, 30, the flat, extended condition of the fabric margins is assured as the fabric is engaged by the edge guides, and also while the fabric is being advanced past the sensing elements and under the presser foot 26 of the sewing machine.

Figure 7:
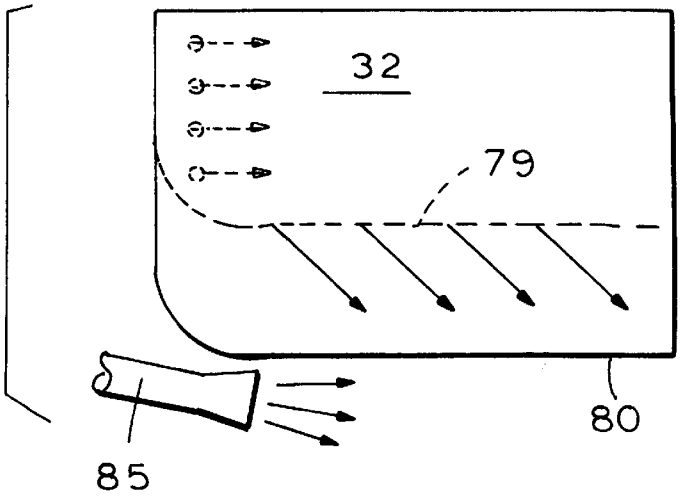
FIG. 7 is a top plan view of the decurler device of FIG. 6.
Figure 8:
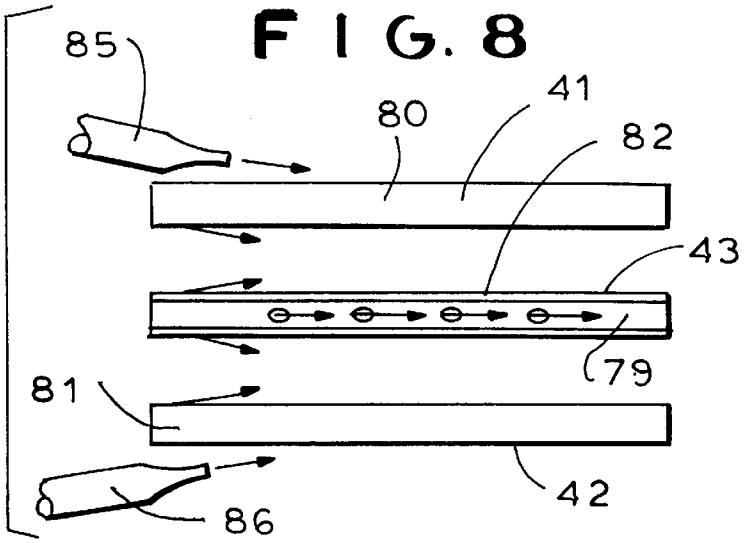
FIG. 8 is a side elevational view of the decurler device of FIG. 6.

For occasions when the character of the fabric is such as to result in an outward curl, as shown at 17*b*, 22*b*, the decurler device advantageously includes upper and lower air nozzles 85, 86 arranged to direct a jet of air along the front edge regions of the upper and lower guide blades 41, 42. As shown in FIGS. 7 and 8, the air jets are angled slightly forward (upstream) and slightly toward the plane of the fabric, so as to flow along the outer surfaces of the fabric margins 17, 22, with the effect of flattening outward edge curls 17*b*, 22*b*.

Whereas for inwardly curled fabric sections, the air streams issuing from openings 82 in the intermediate blade urge the fabric outward against the support of the projecting portions of outer blades 41, 42, when dealing with outward curl, the air jets 85, 86, acting from above and below, urge the two fabric margins into contact with each other, so that each provides support for the other, to facilitate the decurling action and minimize or prevent flagging of the edges.

In the practice of the invention, the operation of sewing a sleeve section to a shirt body section involves a full 360° seam. Accordingly, as the sewing operation nears completion, the leading edge of the sewn seam travels around and approaches the decurler device 32 from the forward or upstream side. When this occurs, it is necessary to laterally retract the center blade 43. Likewise, the separator plate 31, located between the active edge guide devices 29, 30, must be retracted laterally to accommodate passage of the sewn seam. During these final portions of the seaming operation, neither decurling nor edge adjustment can be effectively performed, but neither is particularly significant at this stage, because only a small segment of the fabric remains unsewn, so that the fabric edges are well under control.

The system of the invention enables the production of knitted shirts to be accomplished more economically by effectively automating the sleeve insertion operation in a manner that enables the production to be accomplished at much greater speeds than heretofore, with equipment that is more simplified and more economical than has been proposed heretofore, and while maintaining a high level of product quality. By providing for the support and control of the sleeve sections and the shirt body shoulder openings only in relatively narrow marginal edge areas throughout the sewing process, the necessary manual operations are greatly simplified, as is the equipment required. The equipment utilized in carrying out the invention is universal as to size in that a single piece of equipment can process shirts throughout the full range of sizes without requiring special forms or adapters for different sizes or different groups of sizes.

Among the advantageous features of the invention is the provision of a retractable sleeve support element which extends outward, between the primary guide rollers, during the loading operation. The sleeve section, which is loaded first onto the guide rollers, is supported from underneath by the extended sleeve support minimizing any downward drape of outer end portions of the sleeve section, bearing in mind that only relatively narrow shoulder edge margins of the sleeve sections are supported on the guide rollers themselves. The provision of the extended sleeve support keeps the outer end of the sleeve section up and out of the way while the operator proceeds to load the shoulder opening of a body section onto the guide rollers, in surrounding relation to the sleeve section. In this respect, during the loading of the body section, the entire sleeve section is received within the shoulder opening of the body section. By maintaining the outer end of the sleeve section elevated and supported during this operation, the loading of the body can be greatly expedited.

By organizing a pair of sewing stations in an ergonomic side-by-side relation disposed at an angle of, for example 60°, with the sewing heads and guide rollers of the respective stations facing directly at a centrally positioned operator, the operator may efficiently load first one sewing station and then the other. In this respect, after loading of the first sewing station, and while the sewing operation is being carried out thereon, the operator loads a second sleeve section onto the guide rollers of the second sewing station. By the time the operator completes this loading operation, the sewing at the first station has been completed, and the operator can remove the partially completed shirt from the guide rollers of the first sewing station and load the unsewed second shoulder seam of the body section over the sleeve section that he or she has just previously loaded onto the second sewing station. While the second sewing operation is under way, the operator can load a new sleeve section and shirt body onto the first sewing station in preparation for a new production sequence.

The method and apparatus of the invention not only significantly automates what has heretofore been a labor-intensive and costly operation, but at the same time has enabled a significant quality improvement to be realized. The system of the invention effectively accommodates the automated sleeve insertion of higher quality shirts employing reinforcing tape along the shoulder seam extending from the neck opening to the shoulder opening. In the new system, an otherwise known form of edge-sensing and guiding means is modified in a manner to recognize the passage of an extending tail of reinforcing tape and prevent the unnecessary activation of edge alignment means, attempting to align the projecting tail of reinforcing tape with the sewing axis. To this end, the edge-sensing means for the shirt body shoulder margin includes a pair of spaced-apart sensors located in a position normally spaced away from the edge of the shoulder margin and also spaced apart in the direction of fabric movement a distance slightly greater than the width of the reinforcing tape. The two sensor elements, being spaced apart a distance greater than the width of the reinforcing tape, are associated in a way that actuation of both is necessary to effect a lateral adjustment of the fabric edge, and the two sensors cannot be simultaneously actuated by passage of the reinforcing tape.

To particular advantage, the method and apparatus of the invention do not require excessive stretching of any of the components during the sewing and loading operations. Because the relatively smaller diameter hemmed outer ends of the sleeve sections are not actively engaged during either the loading or sewing operations, there is no need to distort them at all at any stage of the operations. While desirably the edges of the sleeve sections and shirt body shoulder openings to be sewn are maintained under slight tension during the sewing operations, the tension is very light, sufficient only to assist in edge guiding operations and to assure that the two components to be sewn together have equal circumference dimensions during the sewing operations.

Uniformly high quality of product output is enhanced through the use of the decurler device 32 which assures that the fabric margins are flat and fully extended when they are sensed and adjusted, as well as when they are sewn. Effectively dealing with edge curl is particularly important where, as in the basic process of the invention, the shoulder margins of the respective shirt sections are maintained under at least slight tension, in order to provide proper driving and control of the fabric margins, and to enable the sewing operations to be carried out while the respective margins to be sewn together have an effectively identical circumferential length. Thus, even in cases where the size of the shoulder opening in the shirt body may differ slightly from the size of the shoulder margin of the sleeve, the placement of the respective margins under a slight degree of circumferential tension will distend the smaller to a size equal with the slightly less distended size of the larger while the sewing operation takes place. While this significantly enhances the quality of the sewing operation, it tends at the same time to induce at least a slight curl in the fabric edge, which is effectively dealt with by the improvement features of this invention.

The utilization of the described uncurling device further enhances the operation of the sensing device by assuring that the portions of the fabric edge remote from the reinforcing tape are uniform and flat and will effectively trigger both of the sensors 61, 67 when the shirt body edge is displaced too far in that direction.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. Apparatus for sewing knitted sleeve sections to knitted shirt bodies, where the shirt bodies are formed at opposite sides with sleeve openings of the approximate size and shape of an end of a sleeve section to be secured thereto, and where said sleeve sections are supplied with a right-side-out orientation and said shirt bodies are supplied with an inside-out orientation, which comprises (a) a sewing station comprising a pair of spaced-apart guide rollers adapted for the reception and guidance of a shoulder margin of a sleeve section and of a shoulder margin of a shirt body in surrounding relation to said sleeve section, (b) at least one of said guide rollers being movable in a direction to place said shoulder margins under controlled tension during sewing, (c) a retractable sleeve support controllably movable to an extended position directly underneath a sleeve section retained on said guide rollers and supporting said sleeve section during loading of a shirt body shoulder margin onto said guide rollers, (d) said sleeve support being movable to a retracted position during sewing.

2. Apparatus according to claim 1, wherein (a) said guide rollers define a horizontally elongated oblong path for said sleeve section shoulder margin including upper and lower upper and lower path sections extending between said guide rollers, (b) said sleeve support being movable to an extended position closely underneath said lower path section, (c) said sleeve support having a profile to accommodate loading of a shirt body shoulder margin onto said guide rollers in surrounding relation to said sleeve section and said sleeve support.

3. Apparatus for sewing knitted sleeve sections to knitted shirt bodies, where the shirt bodies are formed at opposite sides with sleeve openings of the approximate size and shape of an end of a sleeve section to be secured thereto, and where said sleeve sections are supplied with a right-side-out orientation and said shirt bodies are supplied with an inside-out orientation, which comprises (a) a sewing station comprising a plurality of guide rollers adapted for the reception and guidance of a shoulder margin of a sleeve section, (b) at least one of said guide rollers being movable in a direction to place said sleeve section shoulder margin under controlled tension, (c) first active guide means for controllably and independently laterally adjusting the position of said sleeve section shoulder margin immediately in advance of a sewing operation, (d) said guide rollers being adapted for the reception and guidance of a shoulder margin of a shirt body in closely surrounding relation to said sleeve section shoulder margin, (e) at least one of said guide rollers being movable in a direction to place said shirt body shoulder margin under controlled tension, (f) second active guide means for controllably and independently laterally adjusting the position of said shirt body shoulder margin immediately in advance of a sewing operation, and (g) said first and second active guide means including independently controllably movable fabric engaging elements for moving said respective shoulder margins laterally inward and outward as required during the course of a sewing operation, (h) means for maintaining separation between the respective sleeve section and shirt body shoulder margins in regions in which the respective shoulder margins are engaged by said active guide means in preparation for sewing, characterized by (i) edge decurler means being positioned immediately in advance of the respective first and second active guide means for flattening and extending said shirt body and sleeve section shoulder margins to eliminate edge curl therein, (j) said decurler means comprising upper, lower and intermediate elements forming upper and lower chambers for receiving the respective shoulder margins, (k) air passage means in each of said decurler elements for directing air flows toward edge extremities of said shoulder margins for flattening said margins, (l) the air passage means in said upper and lower decurler elements directing air flows into said upper and lower chambers respectively and the air passage means in said intermediate decurler element directing air flows into both of said chambers whereby each of said shoulder margins within one of said chambers is acted upon by air flows directed toward opposite surfaces of said shoulder margins, and (m) first and second edge sensing means positioned between said edge decurler means and said sewing station and operatively associated with said first and second active guide means, respectively, for controlling independent lateral adjustment of said respective shoulder margins in accordance with the respective positions of the flattened and extended edges thereof.

4. An apparatus according to claim 3, wherein (a) said apparatus includes a controllably driven guide roller for supporting and advancing sleeve and body sections, and (b) said driven guide roller is positioned closely in advance of said edge decurler means.

5. Apparatus for sewing knitted sleeve sections to knitted shirt bodies, where the shirt bodies are formed at opposite sides with sleeve openings of the approximate size and shape of an end of a sleeve section to be secured thereto, and where said sleeve sections are supplied with a right-side-out orientation and said shirt bodies are supplied with an inside-out orientation, which comprises (a) a sewing station comprising a plurality of guide rollers adapted for the reception and guidance of a shoulder margin of a sleeve section, (b) at least one of said guide rollers being movable in a direction to place said sleeve section shoulder margin under controlled tension, (c) first active guide means for controllably laterally adjusting the position of said sleeve section shoulder margin immediately in advance of a sewing operation, (d) said guide rollers being adapted for the reception and guidance of a shoulder margin of a shirt body in closely surrounding relation to said sleeve section shoulder margin, (e) at least one of said guide rollers being movable in a direction to place said shirt body shoulder margin under controlled tension, (f) second active guide means for controllably laterally adjusting the position of said shirt body shoulder margin immediately in advance of a sewing operation, and (g) means for maintaining separation between the respective sleeve section and shirt body shoulder margins in regions in which the respective shoulder margins are engaged by said active guide means in preparation for sewing, characterized by (h) edge decurler means being positioned immediately in advance of said active guide means for flattening and extending said shoulder margins to eliminate edge curl therein, (i) said edge decurler means comprising inner and outer confining blades positioned in closely confining relation with respect to said sleeve section shoulder margin and said body section shoulder margin respectively, (j) an intermediate blade positioned between said inner and outer confining blades and interposed between said sleeve and body sections to define separate confined passages for the respective shoulder margins of said sleeve and body sections, (k) said decurler blades having upstream edges facing in a direction opposite to that in which said shoulder margins are advanced during sewing, (l) the upstream edge of said intermediate blade being recessed in a downstream direction from the upstream edges of said inner and outer guide blades, whereby upstream portions of said inner and outer guide blades form an enlarged entry chamber immediately in advance of said separate confining passages for at least partially decurling said shoulder margins in advance of said confining passages, and (m) first and second edge sensing means being positioned between said edge decurler means and said sewing station and operatively associated with said first and second active guide means, respectively.

6. An apparatus according to claim 5, wherein (a) means are provided for retracting said intermediate blade to accommodate passage of the leading edge of a sewn seam.

7. An apparatus according to claim 5, wherein (a) said intermediate blade is provided along its upstream edge with air outlet openings for directing flows of air in a direction toward the edges of said shoulder margins.

8. An apparatus according to claim 7, wherein (a) said inner and outer guide blades are provided on surfaces thereof facing said intermediate blade with air outlet openings for directing flows of air in a direction toward the edges of said shoulder margins.

9. An apparatus according to claim 8, wherein (a) said intermediate blade is provided on surfaces thereof facing said upper and lower guide blades with outlet openings for directing flows of air in a direction toward the edges of said shoulder margins.

10. An apparatus according to claim 5, wherein (a) air jet nozzles are provided immediately adjacent the forward edges of said inner and outer guide plates, (b) said air jet nozzles being oriented to direct flows of air across the surfaces of said shoulder margins and in a direction toward the edges of said shoulder margins.

11. Apparatus for sewing knitted sleeve sections to knitted shirt bodies, where the shirt bodies are formed at opposite sides with sleeve openings of the approximate size and shape of an end of a sleeve section to be secured thereto, and where said sleeve sections are supplied with a right-side-out orientation and said shirt bodies are supplied with an inside-out orientation, which comprises (a) a sewing station comprising a plurality of guide rollers adapted for the reception and guidance of a shoulder margin of a sleeve section, (b) at least one of said guide rollers being movable in a direction to place said sleeve section shoulder margin under controlled tension, (c) first active guide means for controllably laterally adjusting the position of said sleeve section shoulder margin immediately in advance of a sewing operation, (d) said guide rollers being adapted for the reception and guidance of a shoulder margin of a shirt body in closely surrounding relation to said sleeve section shoulder margin, (e) at least one of said guide rollers being movable in a direction to place said shirt body shoulder margin under controlled tension, (f) second active guide means for controllably laterally adjusting the position of said shirt body shoulder margin immediately in advance of a sewing operation, and (g) means for maintaining separation between the respective sleeve section and shirt body shoulder margins in regions in which the respective shoulder margins are engaged by said active guide means in preparation for sewing, characterized by (h) edge decurler means being positioned immediately in advance of said active guide means for flattening and extending said shoulder margins to eliminate edge curl therein, (i) first and second edge sensing means being positioned between said edge decurler means and said sewing station and operatively associated with said first and second active guide means, respectively, (j) said second edge sensing means comprising first and second sensor elements positioned in straddling relation to a desired line of movement of an edge of said shirt body shoulder margin during sewing, said first sensor element being positioned to sense the presence of fabric, when said body shoulder edge is properly aligned, and said second sensor element being positioned to sense the absence of fabric, when said body shoulder edge is properly aligned, and (k) said second edge sensing means further comprising a third sensor element positioned in spaced apart relation to said second sensor element along the axis of movement of said shoulder margin edge during sewing, (l) said second active edge guide means being responsive to the sensing of the presence of fabric by both of said second and third sensor elements to adjust said body shoulder edge in a direction toward said first sensor element.

12. Apparatus according to claim 11, wherein (a) said shirt body is supplied with a sewn seam extending from a neck opening to said shirt body shoulder edge, (b) a reinforcing tape of predetermined width extends along said sewn seam and projects beyond said shirt body shoulder edge, and (c) said third sensor element is spaced from said second sensor element a distance greater than the width of said reinforcing tape.

13. Apparatus for sewing knitted sleeve sections to knitted shirt bodies, where the shirt bodies are formed at opposite sides with sleeve openings of the approximate size and shape of an end of a sleeve section to be secured thereto, and where said sleeve sections are supplied with a right-side-out orientation and said shirt bodies are supplied with an inside-out orientation, which comprises (a) a sewing station comprising a plurality of guide rollers adapted for the reception and guidance of a shoulder margin of a sleeve section, (b) at least one of said guide rollers being movable in a direction to place said sleeve section shoulder margin under controlled tension, (c) first active guide means for controllably laterally adjusting the position of said sleeve section shoulder margin immediately in advance of a sewing operation, (d) said guide rollers being adapted for the reception and guidance of a shoulder margin of a shirt body in closely surrounding relation to said sleeve section shoulder margin, (e) at least one of said guide rollers being movable in a direction to place said shirt body shoulder margin under controlled tension, (f) second active guide means for controllably laterally adjusting the position of said shirt body shoulder margin immediately in advance of a sewing operation, and (g) means for maintaining separation between the respective sleeve section and shirt body shoulder margins in regions in which the respective shoulder margins are engaged by said active guide means in preparation for sewing, characterized by (h) first and second edge sensing means being positioned in advance of said sewing station and operative associated with said first and second active guide means, respectively, (i) said second edge sensing means comprising first and second sensor elements positioned in straddling relation to a desired line of movement of an edge of said shirt body shoulder margin during sewing, said first sensor element being positioned to sense the presence of fabric, when said body shoulder edge is properly aligned, and said second sensor element being positioned to sense the absence of fabric, when said body shoulder edge is properly aligned, and (j) said second edge sensing means further comprising a third sensor element positioned in spaced apart relation to said second sensor element along the axis of movement of said shoulder margin edge during sewing, (k) said second active edge guide means being responsive to the sensing of the presence of fabric by both of said second and third sensor elements to adjust said body shoulder edge in a direction toward said first sensor element.

14. Apparatus according to claim 13, wherein (a) said shirt body is supplied with a sewn seam extending from a neck opening to said shirt body shoulder edge, (b) a reinforcing tape of predetermined width extends along said sewn seam and projects beyond said shirt body shoulder edge, and (c) said third sensor element is spaced from said second sensor element a distance greater than the width of said reinforcing tape.

15. An edge sensing and adjustment system for aligning a fabric edge interrupted by a projecting element of predetermined width, which comprises (a) an edge guide device operative when controllably actuated to adjust said fabric edge laterally with respect to a predetermined alignment reference while said fabric edge is being advanced longitudinally relative to said edge guide device, (b) a first sensor element positioned on one side of said alignment reference and operative when sensing the absence of fabric to actuate said edge guide device to adjust said fabric edge accordingly, (c) a second sensor element spaced laterally from said first sensor element and on the opposite side of said alignment reference therefrom, (d) a third sensor element spaced longitudinally from said second sensor element a distance greater than the width of said projecting element, (e) control means operative when both said second and third sensor elements sense the presence of fabric to actuate said edge guide device to adjust said fabric edge accordingly, (f) said second and third sensor elements being inoperative to actuate said edge guide device when the presence of fabric is sensed by only one of them.

16. The method of sewing knitted sleeve sections to knitted shirt bodies, which comprises (a) providing first and second sewing stations arranged at an angle with respect to an operator station and each including a pair of guide rollers for engaging and supporting shoulder edge margins of a sleeve section and of a shirt body section, (b) loading the shoulder edge margin of a first sleeve section onto guide rollers of the first sewing station, with said sleeve section having an outside-out orientation, (c) thereafter loading a first shoulder edge margin of a shirt body over the guide rollers of said first sewing station, in closely surrounding relation to the shoulder edge margin of said first sleeve section, (d) initiating a first sewing operation at said first sewing station to sew said first sleeve section to said shirt body, (e) while said sewing first operation is being carried out, loading the shoulder edge margin of a second sleeve section onto guide rollers of said second sewing station, (f) upon completion of said first sewing operation, removing said shirt body from said first sewing station and loading a second shoulder edge margin of said shirt body over the guide rollers of said second sewing station in closely surrounding relation to the shoulder edge margin of said second sleeve section, (g) initiating a second sewing operation at said second sewing station, and (h) while said second sewing operation is being carried out, commencing loading of said first sewing station.

17. A method according to claim 16, further including (a) providing temporary support for outer end portions of said sleeve sections from underneath, during loading of shirt body shoulder edge margins in surrounding relation thereto, and (b) withdrawing said support during said sewing operations.

18. The method of sewing knitted sleeve sections to knitted shirt bodies, which comprises, (a) providing said sleeve sections with a right-side-out orientation and shirt bodies with an inside-out orientation, (b) said shirt bodies being formed at opposite sides with sleeve openings of the approximate size and shape of an end of a sleeve section to be secured thereto, (c) mounting a shoulder margin of a sleeve section on a load fixture by placing said sleeve shoulder margin over at least two guide rollers forming part of said load fixture, (d) loading one side of a shirt body onto said load fixture with a shoulder margin of said shirt body closely surrounding the shoulder margin of said sleeve section, (e) moving one of said guide rollers in a direction away from the other to place said shoulder margins under light controlled tension, (f) directing flows of air toward said respective edge margins to flatten and decurl said margins, and (f) immediately thereafter independently edge guiding the respective shoulder margins while advancing said edge margins to a sewing head.

19. A method according to claim 18, wherein (a) while continuing to direct flows of air toward said edge margins, and prior to independently edge guiding the respective shoulder margins, said margins are directed through confined passages.

20. A method according to claim 19, wherein (a) certain of said flows of air are directed between said shoulder margins prior to said shoulder margins being directed through said confined passages, and (b) while said certain flows of air are being so directed, said shoulder margins are confined against excessive separation and flattened.

21. A method according to claim 19, wherein (a) certain of said flows of air are directed over and partly toward externally exposed surfaces of said shoulder margins, prior to said shoulder margins being directed through said confined passages, causing said margins to be simultaneously flattened and urged toward each other.

* * * * *